US006431919B1

(12) United States Patent
Wang et al.

(10) Patent No.: US 6,431,919 B1
(45) Date of Patent: Aug. 13, 2002

(54) RECEPTACLE CONNECTOR ASSEMBLY WITH KEYING DEVICES

(75) Inventors: Suiya Wang; Guang Xing Shi, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/953,651

(22) Filed: Sep. 12, 2001

(30) Foreign Application Priority Data

Jun. 22, 2001 (TW) ..... 90210519 U

(51) Int. Cl.[7] ..... H01R 13/64
(52) U.S. Cl. ..... 439/680; 439/490
(58) Field of Search ..... 439/680, 677, 439/607, 608, 490, 681

(56) References Cited

U.S. PATENT DOCUMENTS 4,693,531 A * 9/1987 Raphal et al. ..... 439/680
4,900,274 A * 2/1990 Dorleans et al. ..... 439/680
5,129,831 A * 7/1992 Locak ..... 439/680
5,980,320 A * 11/1999 Slack et al. ..... 439/607
6,257,935 B1 7/2001 Zhang
6,312,293 B1 11/2001 Wang
6,319,070 B1 11/2001 Tan

* cited by examiner

*Primary Examiner*—Hien Vu
(74) *Attorney, Agent, or Firm*—WeiTe Chung

(57) ABSTRACT

A receptacle connector assembly (1) comprises an insulative housing (18) with a number of contacts (31, 41) retained therein and a pair of keying devices (50). The housing defines a first large-dimensioned receiving cavity (11) and a second small-dimensioned receiving cavity (21). The first receiving cavity has a channel (17). Each keying device comprises an engaging portion (511; 521) received in the first receiving cavity for being pushed outward by the mating plug connector, a resilient portion (513; 523) extending from the engaging portion, and a tongue (512; 522) extending from the resilient portion and projecting into the channel.

5 Claims, 8 Drawing Sheets

RECEPTACLE CONNECTOR ASSEMBLY WITH KEYING DEVICES

BACKGROUND OF THE INVENTION

1. Field of the Invention

The present invention relates to a receptacle connector assembly, and particularly to a receptacle connector assembly with keying devices for preventing an unmating plug connector from being inserted thereinto.

2. Description of the Related Art

Generally, a receptacle connector assembly comprises an RJ45 receptacle connector and an RJ11 receptacle connector arranged in a side-by-side manner. The RJ45 receptacle connector has a larger size than the RJ11 receptacle connector. Therefore, an RJ11 plug connector adapted for mating with the RJ11 receptacle connector is easy to be misplugged into the RJ45 receptacle connector. When the RJ11 plug connector is inserted into the RJ45 receptacle connector, contacts received in the RJ45 receptacle connector may be damaged. Furthermore, the electrical capability of the contacts may be adversely affected. U.S. Pat. No. 6,022,246 discloses a connector assembly including a male connector and a female connector. The male connector includes at least one row of sleeve members for receiving receptacle contacts therein. The female connector defines a plurality of cavities for receiving plug contacts therein. A pair of keys are respectively disposed on two sleeve members at two opposite ends, and a pair of keyways are respectively defined, communicating with two cavities at two opposite ends, thereby preventing mismating of the connector assembly. However, this design cannot prevent a small-dimensioned RJ11 plug connector from being inserted into a large-dimensioned RJ45 receptacle connector. The copending TW patent application Ser. No. 89215868, filed on Sep., 14, 2000 and assigned to the same assignee, discloses an RJ45 receptacle connector with a pair of keying devices for preventing an RJ11 plug connector from being inserted thereinto. In such design, the keying devices are assembled to the RJ45 receptacle connector from two opposite sides thereof, respectively. The copending application Ser. No. 09/721,827 filed on Nov. 22, 2000 having the same inventor and the same assignee with the instant application substantially discloses the similar "single" port modular jack with anti-mismating means thereof. However, for the side-by-side "dual" ports arrangement, the receptacle connector assembly includes a unitarily molded housing, wherein the RJ45 receptacle connector has an exposed sidewall and an opposite unexposed sidewall. Obviously, it is difficult to assemble one of the keying devices onto the unexposed sidewall of the RJ45 receptacle connector.

Hence, an improved receptacle connector assembly with keying devices is desired to overcome the disadvantages of the related art.

SUMMARY OF THE INVENTION

An object of the present invention is to provide a receptacle connector assembly having a pair of keying devices for preventing an unmating plug connector from being inserted thereinto.

To achieve the above-mentioned object, a receptacle connector assembly in accordance with the present invention comprises an insulative housing with a plurality of contacts retained therein and a pair of keying devices. The housing defines in a mating face thereof a first large-dimensioned receiving cavity adapted for receiving a first large-dimensioned plug connector and a second small-dimensioned receiving cavity adapted for receiving a second small-dimensioned plug connector. The first receiving cavity has a channel adapted for receiving a projection of the first plug connector. The housing has a partition separating the first receiving cavity from the second receiving cavity and a sidewall opposite to the partition and adjacent to the first receiving cavity. The housing defines a first cutout and a slit in the sidewall. The housing defines a second cutout extending from a rear face thereof proximate to the partition and an inwardly extending recess communicating with the second cutout. The pair of keying devices are assembled to the housing respectively from the first cutout and the second cutout. The keying devices comprise a pair of respective tail portions respectively retained in the slit and the recess, a pair of respective resilient portions forwardly extending from corresponding tail portions, a pair of respective engaging portions extending from corresponding resilient portions and received in a front position of the first receiving cavity for being pushed away from each other by the first plug connector, and a pair of respective tongues extending from the resilient portions and projecting into the channel. The tongues lie in a common horizontal plane functioning as a stop for preventing the second plug connector from being inserted into the first receiving cavity. The pair of engaging portions are spaced a distance smaller than the width of the first receiving cavity but larger than the width of the second receiving cavity.

When the first plug connector is inserted into the first receiving cavity, the engaging portions are pushed away from each other to actuate the tongues to move away from each other, whereby the first plug connector is successfully inserted into the first receiving cavity. Contrarily, when the second plug connector is inserted into the first receiving cavity, the engaging portions cannot be pushed away from each other. As a result, the tongues also cannot be pushed away from each other, thereby stopping the second plug connector from being inserted into the first receiving cavity.

Other objects, advantages and novel features of the invention will become more apparent from the following detailed description of the present embodiment when taken in conjunction with the accompanying drawings.

DETAILED DESCRIPTION OF THE INVENTION

Figure 1:
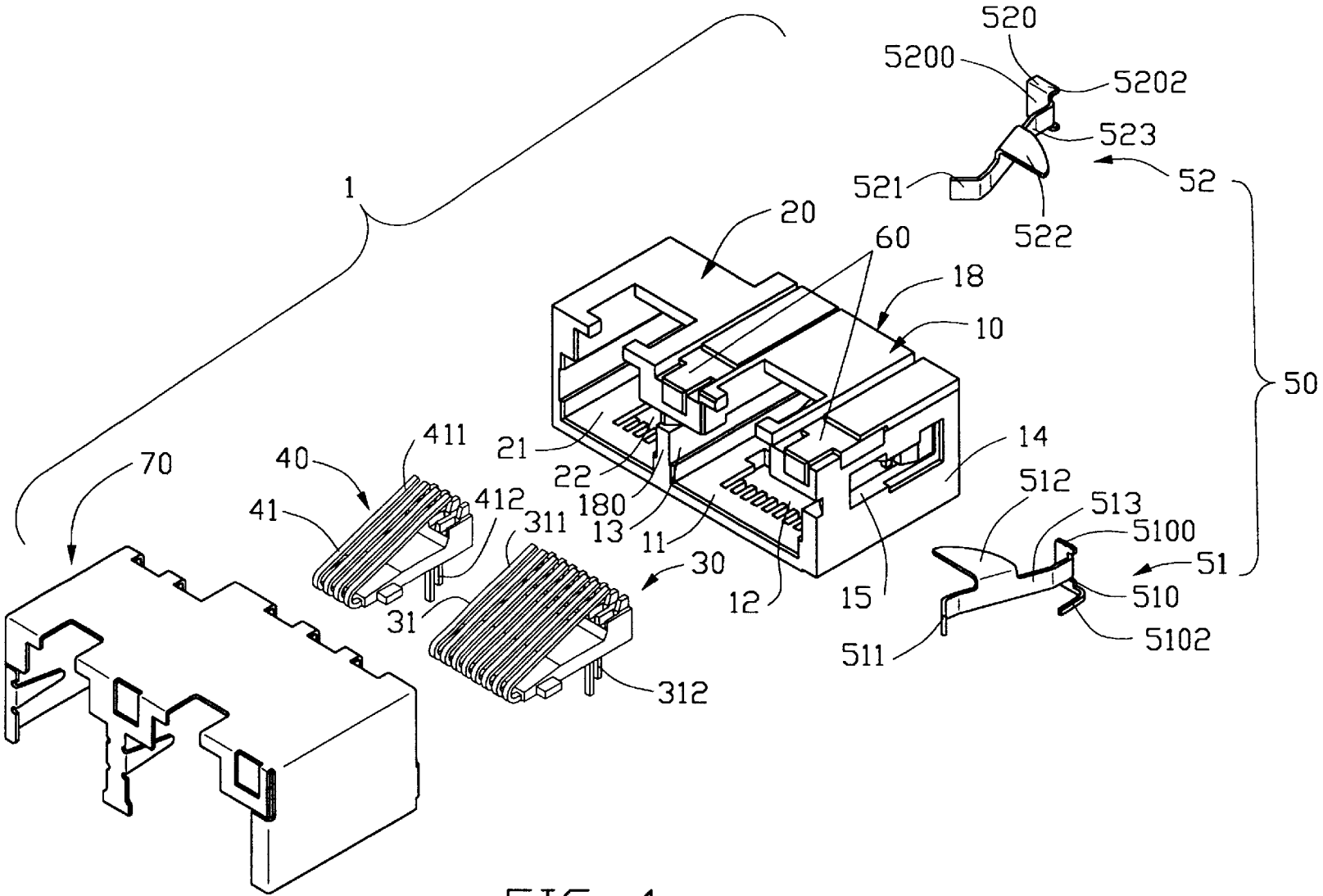
FIG. 1 is an exploded, perspective view of a receptacle connector assembly consisting of an RJ45 receptacle connector and an RJ11 receptacle connector arranged in a side-by-side manner in accordance with the present invention.
Figure 4:
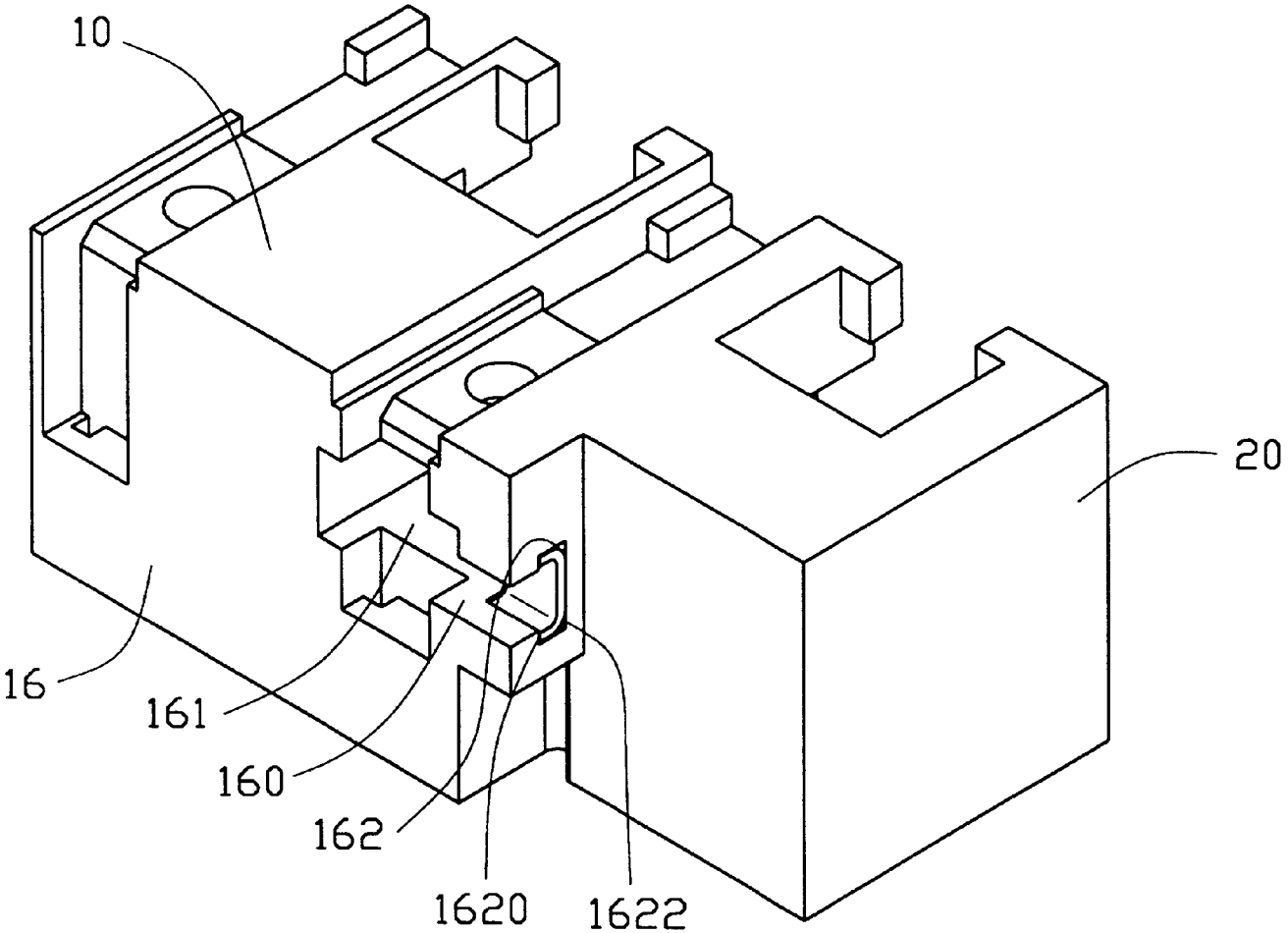
FIG. 4 is a view similar to FIG. 3 but taken from a different perspective.

Referring to FIGS. 1 and 4, a receptacle connector assembly 1 in accordance with the present invention consists of an RJ45 receptacle connector and an RJ11 receptacle connector arranged in a side-by-side manner. The receptacle connector assembly 1 comprises a unitarily molded insulative housing 18, a first contact module 30 and a second contact module 40 both retained in the housing 18, a pair of Light-Emitting Diodes (LEDs) 60 secured to the housing 18, a pair of keying devices 50, and a shell 70 enclosing the insulative housing 18.

Figure 3:
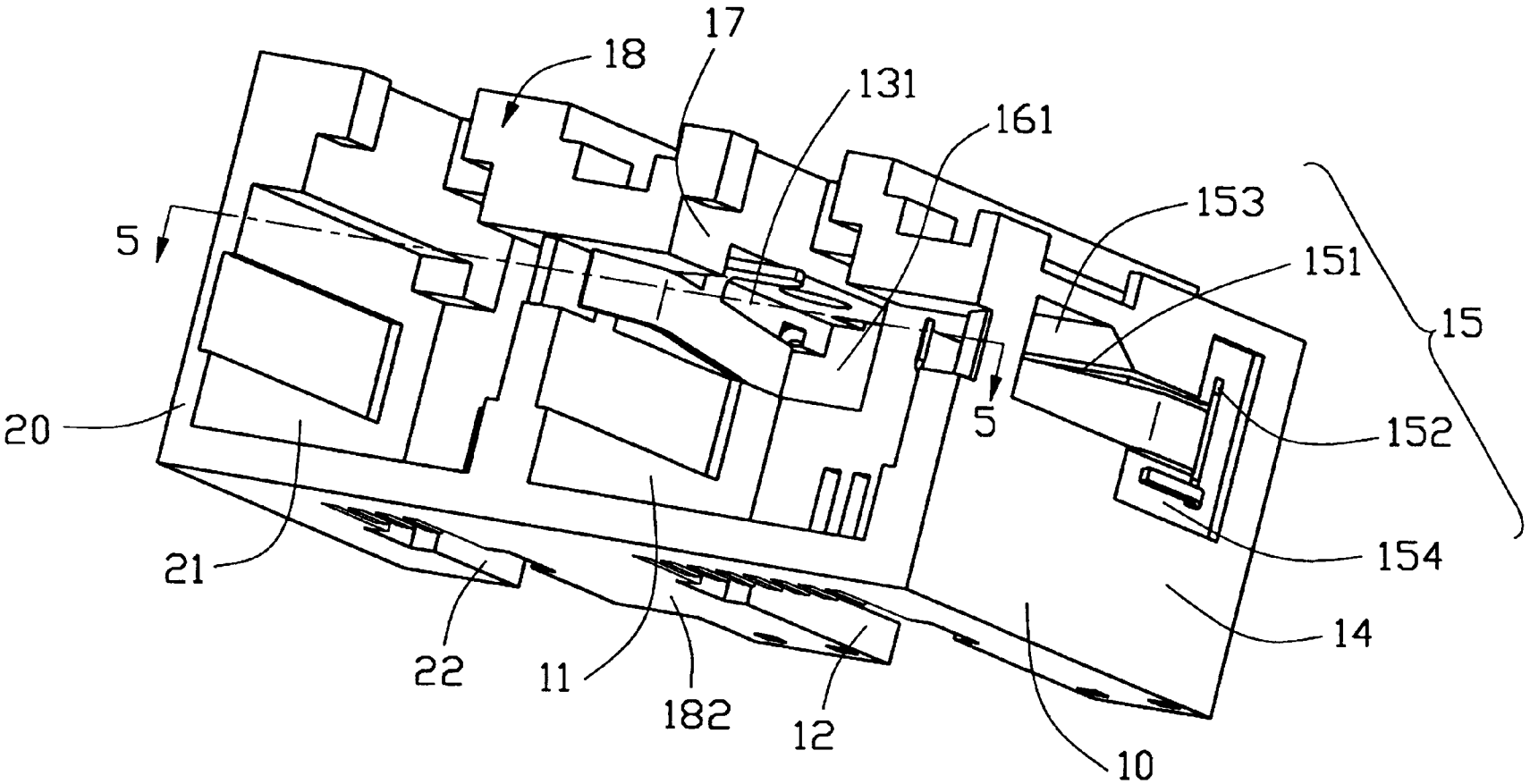
FIG. 3 is a perspective view of an insulative housing of the receptacle connector assembly with a pair of keying devices assembled thereto.

The insulative housing 18 has a mating face 180 and a mounting face 182 (FIG. 3). The housing 18 comprises a first housing 10 and a second housing 20 arranged in a side-by-side manner. The first housing 10 defines a first large-dimensioned receiving cavity 11 in the mating face 180 for receiving an RJ45 plug connector 2 (schematically shown in FIG. 6). The first receiving cavity 11 has an upper channel 17 (FIG. 3) adapted for receiving a projection 220 (FIG. 6) of the inserted RJ45 plug connector 2. The second housing 20 defines a second small-dimensioned receiving cavity 21 in the mating face 180 for receiving an RJ11 plug connector (not shown). The first receiving cavity 11 is separated from the second receiving cavity 21 by a partition 13. The first housing 10 defines a first opening 12 in the mounting face 182 joining the first receiving cavity 11. The second housing 20 defines a second opening 22 in the mounting face 182 joining the second receiving cavity 21.

Figure 5:
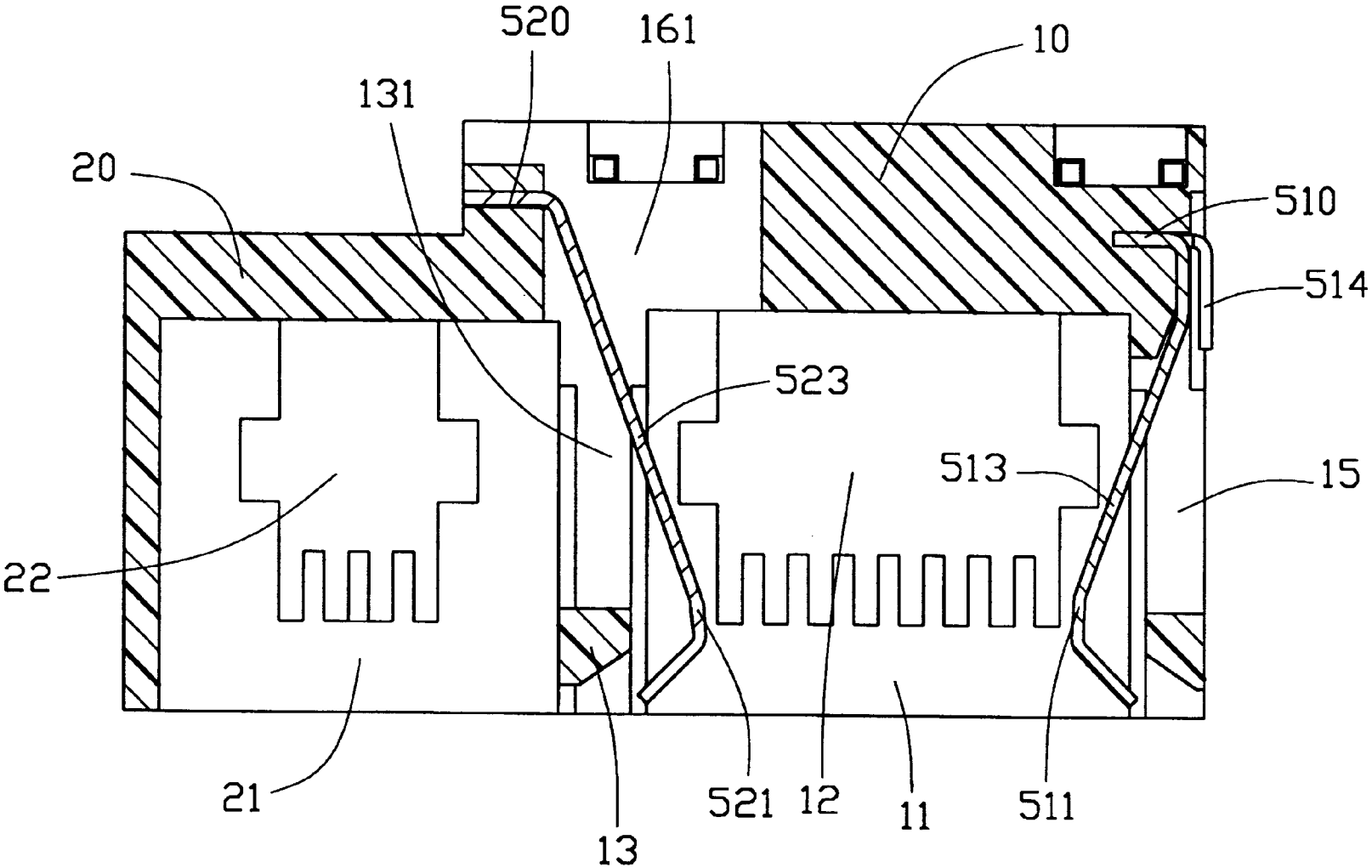
FIG. 5 is a cross-sectional view of the insulative housing taken along section line 5—5 in FIG. 3.

Also referring to FIGS. 3 and 5, the first housing 10 defines a keying notch 15 in a sidewall 14 thereof. The keying notch 15 has a first cutout 151 and a first slot 153 both adjacent to the mating face 180 and joining the first receiving cavity 11, an inwardly extending slit 152 in a direction perpendicular to the sidewall 14 and a depression 154 communicating with the first cutout 151. The first housing 10 defines a second cutout 161 adjacent to the partition 13 extending from a rear face 16 thereof. The second cutout 161 extends into the first receiving cavity 11 and forms a second slot 131 proximate to the partition 13. A concavity 160 is defined in the rear face 16 at a corner of the first housing 10 and the second housing 20 communicating with the second cutout 161. The first housing 10 defines an inwardly extending recess 162 communicating with the concavity 160. The recess 162 has a pair of stop faces 1620 and a contact face 1622 opposite to the stop faces 1620.

The first contact module 30 includes a plurality of first contacts 31 retained therein. Each first contact 31 has a first mating portion 311 for electrically engaging with corresponding contacts of the RJ45 plug connector and a first tail portion 312 for connection with a printed circuit board (not shown). The second contact module 40 includes a plurality of second contacts 41 retained therein. Each second contact 41 has a second mating portion 411 for electrically engaging with corresponding contacts of the RJ11 plug connector and a second tail portion 412 for connection with the printed circuit board.

The keying devices 50 made of electrical material comprise a first keying device 51 positioned adjacent to the sidewall 14 of the first housing 10 and a second keying device 52 positioned adjacent to the partition 13. The first keying device 51 has a first tail portion 510, a first resilient portion 513 forwardly extending from the first tail portion 510, a first engaging portion 511 forwardly and outwardly extending from the first resilient portion 513, and a first tongue 512 inwardly extending from an upper edge of the first resilient portion 513. The first tongue 512 functions as a stop. The second keying device 52, which has a configuration substantially the same as that of the first keying device 51, has a second tail portion 520, a second resilient portion 523 forwardly extending from the second tail portion 520, a second engaging portion 521 forwardly and outwardly extending from the second resilient portion 523, and a second tongue 522 inwardly extending from an upper edge of the second resilient portion 523. The second tongue 512 functions as a stop. The first tail portion 510 of the first keying device 51 includes a first rectangular base portion 5100 and an L-shaped first fixed portion 5102 extending outwardly from a lower position of the first base portion 5100. The second tail portion 520 of the second keying device 52 includes a second rectangular base portion 5200 and a pair of second fixed portions 5202 respectively extending from opposite edges of the second base portion 5200.

Figure 2:
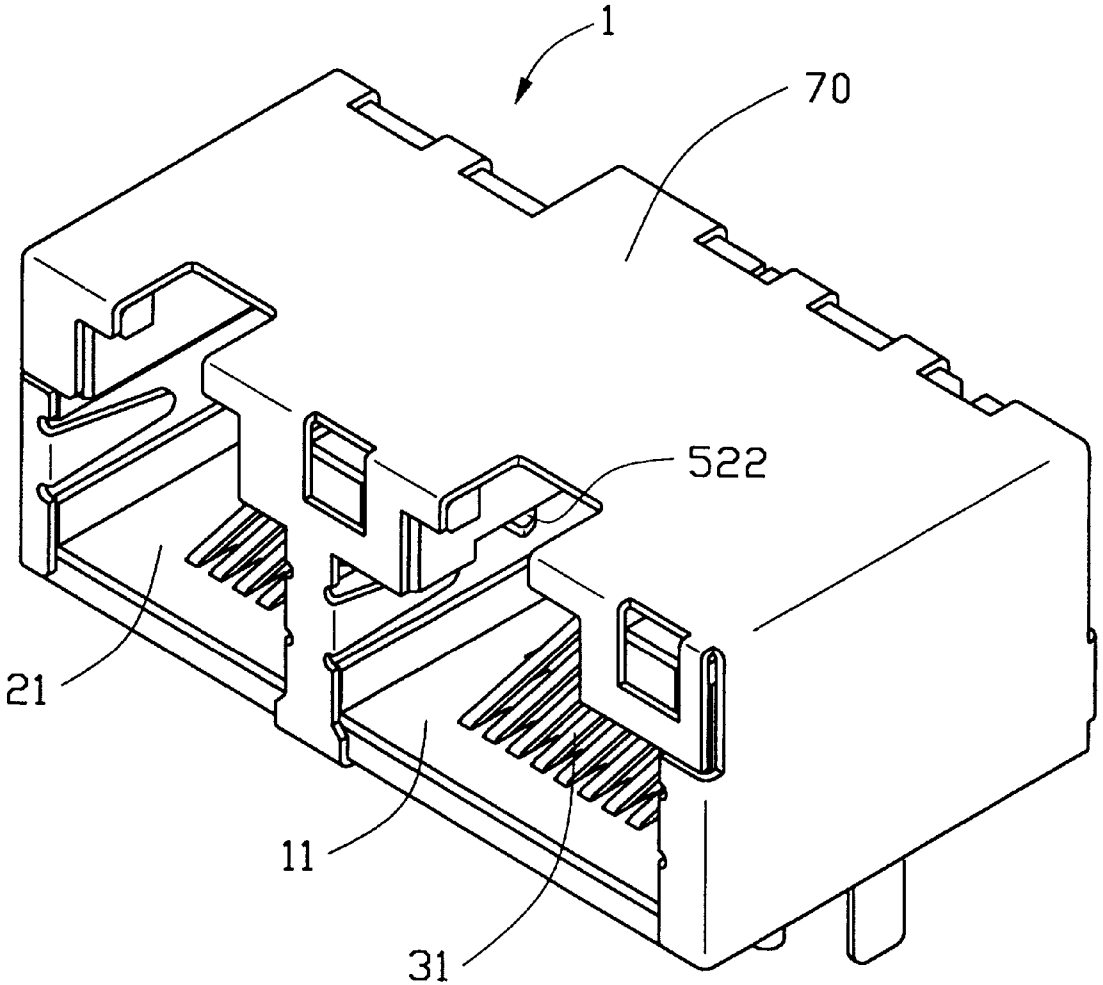
FIG. 2 is an assembled, perspective view of FIG. 1.

Further referring to FIGS. 1, 2 and 5, in assembly, the first contact module 30 is assembled to the first housing 10 via the first opening 12. The first mating portions 311 of the first contacts 31 are received in the first receiving cavity 11 for engaging with the inserted RJ45 plug connector. The first tail portions 312 of the first contacts 31 extend through the mounting face 182 of the housing 18 for connection with the printed circuit board. The second contact module 40 is assembled to the second housing 20 via the second opening 22. The second mating portions 411 of the second contacts 41 are received in the second receiving cavity 21 for engaging with the inserted RJ11 plug connector. The second tail portions 412 of the second contacts 41 extend through the mounting face 182 of the housing 18 for connection with the printed circuit board.

The first keying device 51 is assembled to the first housing 10 via the keying notch 15 in the sidewall 14. The first engaging portion 511 and the first tongue 512 extend into the first receiving cavity 11. The first base portion 5100 of the first tail portion 510 is received in the slit 152. The first fixed portion 5102 of the first tail portion 510 is received in the depression 154. The second keying device 52 is inserted into the first housing 10 via the second cutout 161. The second engaging portion 521 and the second tongue 522 extend into the first receiving cavity 11. The second tail portion 520 firstly extends through the concavity 160 under a compressed condition, and then springs upwardly to make the fixed portions 5202 abutting against the stop faces 1620 and to make the base portion 5200 abutting against the contact face 1622. Thus, the tail portion 520 is firmly fixed in the recess 162.

When the shell 70 encloses the insulative housing 18, the first fixed portion 5102 of the first keying device 51 is sandwiched between the first housing 10 and the shell 70, whereby the first keying device 51 is stably fixed in the first housing 10. Further, the first fixed portion 5102 abuts against the shell 70 to provide a grounding path between the inserted RJ45 plug connector and the printed circuit board on which the receptacle connector assembly 1 is mounted. At the same time, the second tail portion 520 of the second keying device 52 abuts against the shell 70 to protect the second keying device 52 from extraction. A grounding path is also provided between the inserted RJ11 plug connector and the printed circuit board on which the receptacle connector assembly 1 is mounted.

Figure 6:
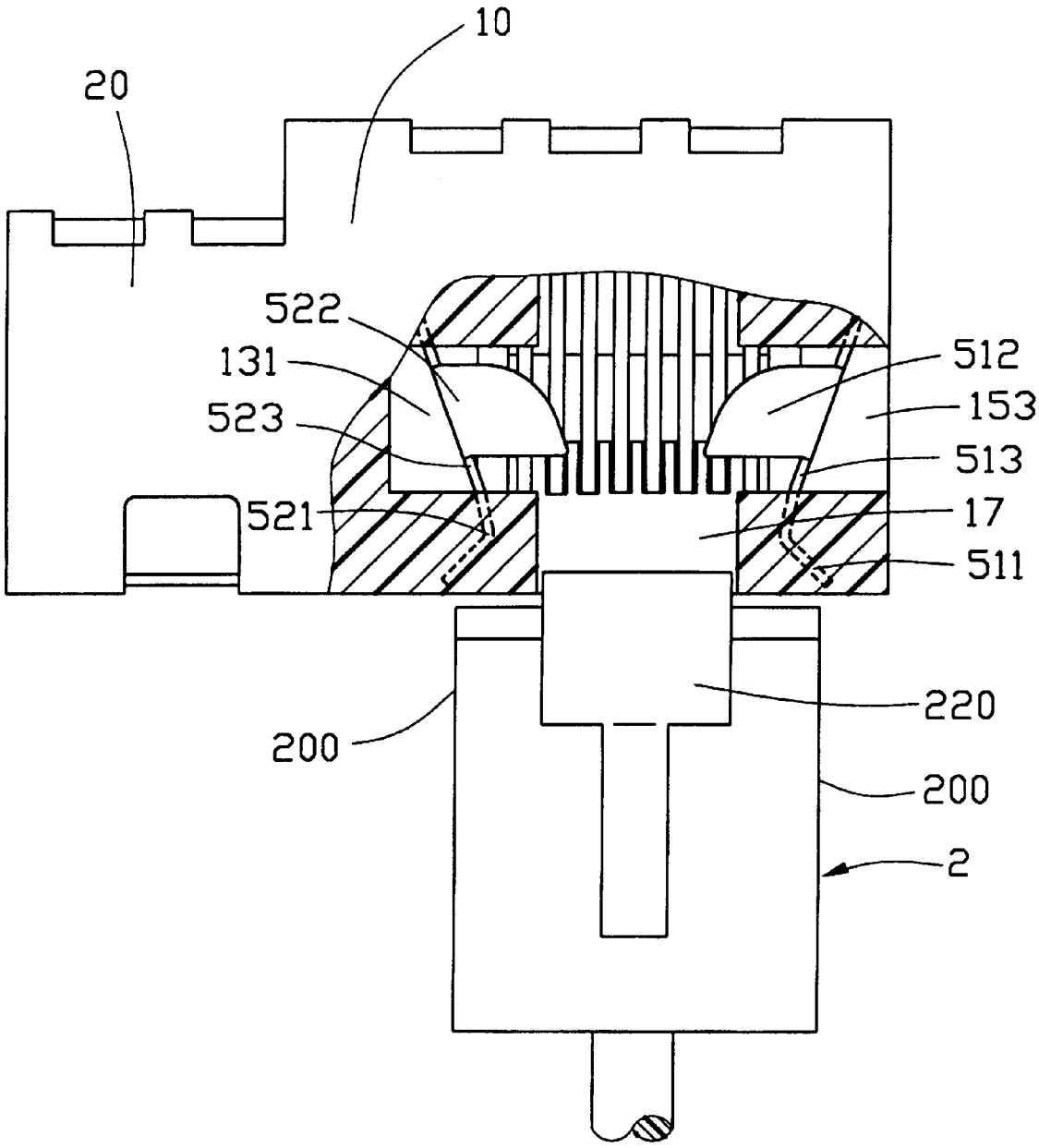
FIG. 6 is a partially cross-sectional view showing the keying devices in an original position with respective to the housing before insertion of an RJ45 plug connector.

Referring to FIG. 6, the first keying device 51 and the second keying device 52 are symmetrically positioned on opposite sides of the first receiving cavity 11. The first tongue 512 of the first keying device 51 and the second tongue 522 of the second keying device 52 extend into the channel 17 and lie in a common horizontal plane. Therefore, a distance between the first tongue 512 and the second tongue 522 is smaller than the width of the channel 17. The first engaging portion 511 and the second engaging portion 521 are received in a front portion of the first receiving cavity 11. A distance between the first engaging portion 511 and the second engaging portion 521 is smaller than the width of the first receiving cavity 11 but larger than the width of the second receiving cavity 21.

Figure 7:
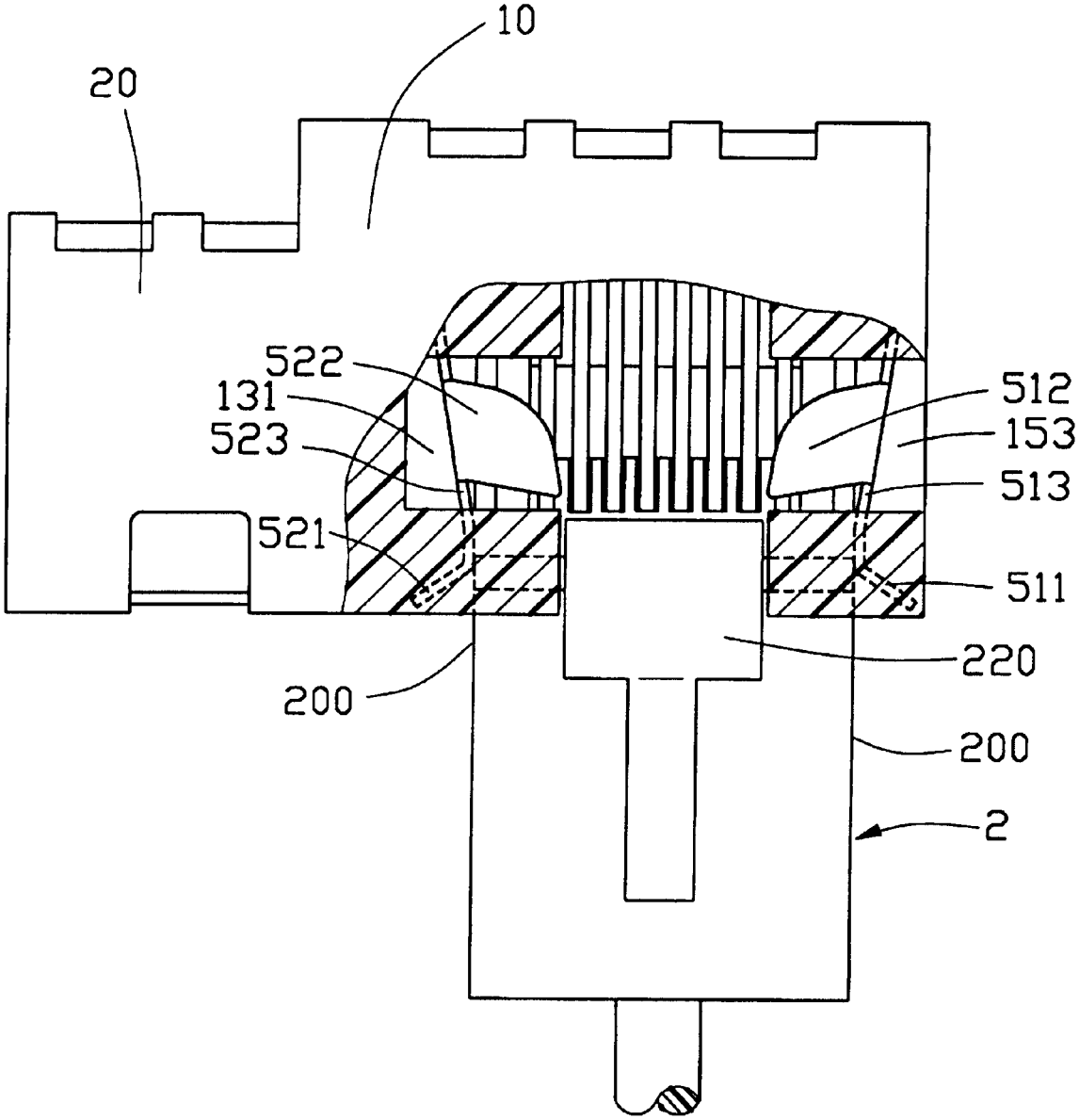
FIG. 7 is a partially cross-sectional view showing the keying devices being pushed away from each other when the RJ45 plug connector is inserted into a first receiving cavity of the housing.
Figure 8:
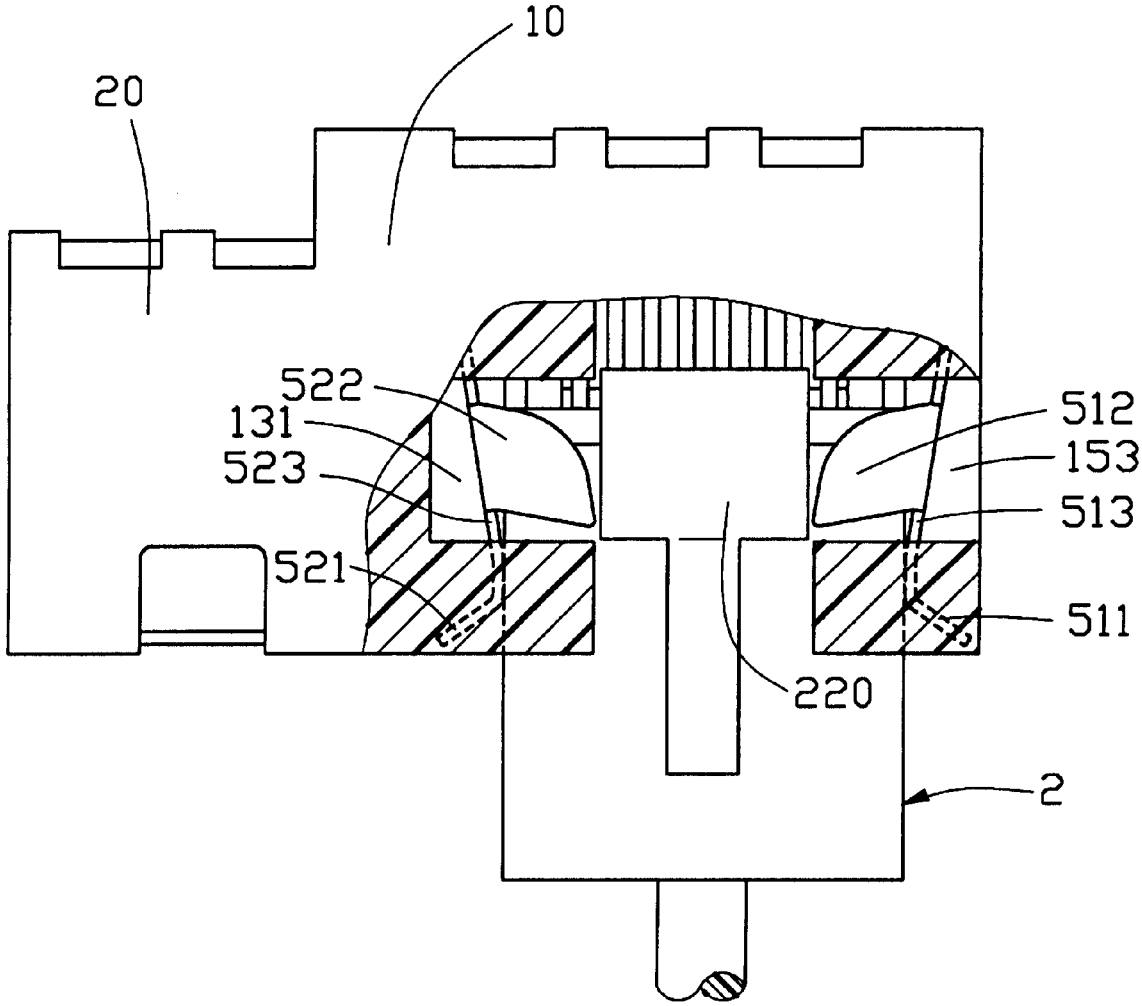
FIG. 8 is a partially cross-sectional view showing the keying devices in a final position when the RJ45 plug connector is completely inserted into the first receiving cavity.

Referring to FIGS. 6, 7 and 8, because the width of the RJ45 plug connector 2 is larger than the distance between the first engaging portion 511 and the second engaging portion 521, when the RJ45 plug connector 2 is inserted into the first receiving cavity 11 of the first housing 10, two opposite sides 200 of the RJ45 plug connector 2 respectively bias against the first engaging portion 511 and the second engaging portion 521 to actuate the first resilient portion 513 and the second resilient portion 523 to move away from each other. As a result, the first tongue 512 moves into the first slot 153 and the second tongue 522 moves into the second slot 131, whereby the projection 220 of the RJ45 plug connector 2 is successfully inserted into the channel 17. Thus, the RJ45 plug connector 2 can be completely inserted into the first receiving cavity 11 of the receptacle connector assembly 1.

Contrarily, because the width of the RJ11 plug connector, which is adapted for engaging with the second receiving cavity 21, is smaller than the distance between the first engaging portion 511 and the second engaging portion 521, when the RJ11 plug connector is inserted into the first receiving cavity 11 of the first housing 10, the first engaging portion 511 and the second engaging portion 512 cannot be pushed away from each other. Accordingly, the first tongue 512 and the second tongue 522 cannot be pushed away from the channel 17, thereby stopping the RJ11 plug connector from entering into the first receiving cavity 11 of the first housing 10. Thus, the receptacle connector assembly 1 with the keying devices 50 can prevent the RJ11 plug connector from being inserted into the first receiving cavity 11, whereby the contacts 31 received in the first receiving cavity 11 are protected from damage and the electrical capability of the contacts 31 is ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector assembly comprising:

an insulative housing and a plurality of contacts retained in the housing, the housing defining in a mating face thereof, a first large-dimensioned receiving cavity adapted for receiving a first large-dimensioned plug connector and a second small-dimensioned receiving cavity adapted for receiving a second small-dimensioned plug connector, the first receiving cavity having a channel adapted for receiving a projection of the first plug connector, the housing having a partition separating the first receiving cavity from the second receiving cavity and a sidewall opposite to the partition and adjacent to the first receiving cavity, the housing defining a first cutout and a slit in the sidewall, the housing defining a second cutout extending from a rear face thereof proximate to the partition and an inwardly extending recess communicating with the second cutout; and a pair of keying devices assembled to the housing respectively from the first cutout and the second cutout, the keying devices comprising a pair of respective tail portions respectively retained in the slit and the recess, a pair of respective resilient portions forwardly extending from corresponding tail portions, a pair of respective engaging portions extending from corresponding resilient portions and received in a front position of the first receiving cavity for being pushed away from each other by the first plug connector, and a pair of respective tongues extending from the resilient portions and projecting into the channel for preventing the second plug connector from being inserted into the first receiving cavity; wherein the pair of tongues of the keying devices lie in a common horizontal plane; wherein the pair of engaging portions of the keying devices are spaced a distance smaller than the width of the first receiving cavity but larger than the width of the second receiving cavity.

2. The receptacle connector assembly as claimed in claim 1, wherein the first cutout is adjacent to the mating face of the housing and communicating with the first receiving cavity, and wherein the slit is adjacent to the rear face of the housing.

3. The receptacle connector assembly as claimed in claim 1, wherein the second cutout extends through the partition and communicates with the first receiving cavity.

4. The receptacle connector assembly as claimed in claim 1, wherein the housing defines a concavity extending from the rear face at a corner thereof, the inwardly extending recess communicating with the concavity.

5. A receptacle connector assembly comprising:

a unitary insulative housing defining side by side a first receiving cavity for receiving a first plug and a second receiving cavity for receiving a second plug, said first receiving cavity being larger than the second receiving cavity while sharing a same partition wall with the second receiving cavity therebetween;

each of said first receiving cavity and said second cavity further including a channel in communication with the corresponding cavity for receiving a projection of either one of said first and second plugs;

first and second keying devices respectively attached to a side wall and the partition wall beside said first receiving cavity, each of said first and second keying devices defining an engaging portion extending into the first receiving cavity, a tongue extending into the corresponding channel beside said first cavity, and a tail fixing section; wherein the housing defines a first cutout in the side wall to allow the first keying device to be assembled to the housing in a lateral/inward direction, and further defines a second cutout in and around the partition wall to allow the second keying device to be assembled to the housing in a back-to-front direction; wherein a pair of LED devices are assembled to the housing respectively generally aligned with the corresponding keying devices in a vertical direction, and one of the LED devices is assembled to a top of the partition wall after the second keying device is assembled to the housing for not obstructing assembling of the second keying device into the housing; wherein;

the tail fixing section of the second keying device is located around a rear portion of the second cavity instead of a rear portion of the partition wall.

* * * * *